US008915576B2

(12) United States Patent
Uezawa

(10) Patent No.: US 8,915,576 B2
(45) Date of Patent: Dec. 23, 2014

(54) LIQUID EJECTING HEAD AND LIQUID EJECTING APPARATUS

(71) Applicant: Seiko Epson Corporation, Tokyo (JP)

(72) Inventor: Haruhisa Uezawa, Shiojiri (JP)

(73) Assignee: Seiko Epson Corporation (JP)

( * ) Notice: Subject to any disclaimer, the term of this patent is extended or adjusted under 35 U.S.C. 154(b) by 109 days.

(21) Appl. No.: 13/782,199

(22) Filed: Mar. 1, 2013

(65) Prior Publication Data

US 2013/0233939 A1 Sep. 12, 2013

(30) Foreign Application Priority Data

Mar. 7, 2012 (JP) ..... 2012-051039

(51) Int. Cl.
*B41J 2/14* (2006.01)
*B05B 17/06* (2006.01)

(52) U.S. Cl.
CPC ..... *B05B 17/0615* (2013.01); *B41J 2202/12* (2013.01); *B41J 2/14274* (2013.01)
USPC ..... 347/47

(58) Field of Classification Search
None
See application file for complete search history.

(56) References Cited

U.S. PATENT DOCUMENTS

| | | | | |
|---|---|---|---|---|
| 7,222,945 | B2 * | 5/2007 | Tseng et al. | 347/62 |
| 8,162,446 | B2 * | 4/2012 | Tomizawa et al. | 347/62 |
| 8,172,371 | B2 * | 5/2012 | Ishida et al. | 347/63 |
| 2002/0180827 | A1 | 12/2002 | Hirota | |

FOREIGN PATENT DOCUMENTS

| | | |
|---|---|---|
| JP | 3097718 | 5/1994 |
| JP | 2002-355961 | 12/2002 |

* cited by examiner

*Primary Examiner* — Lamson Nguyen
(74) *Attorney, Agent, or Firm* — Harness, Dickey & Pierce, P.L.C.

(57) ABSTRACT

A ink jet type recording head which circulates ink between a first manifold and a second manifold via a pressure generation chamber is provided, the flow path member has a first and second bypass flow paths which connect the first and second manifolds, respectively in two locations of one end side and the other end side of a nozzle row on the outside of the nozzle row on which the nozzle openings are formed, and a relationship between a flow path resistance R of the first and second bypass flow paths, and a flow path resistance r of a flow path portion including the pressure generation chamber which connects the first and second manifolds is R<r/N (wherein, N is the number of all nozzle openings).

4 Claims, 5 Drawing Sheets

LIQUID EJECTING HEAD AND LIQUID EJECTING APPARATUS

BACKGROUND

1. Technical Field

The present invention relates to a liquid ejecting head and a liquid ejecting apparatus, and more particularly, to a liquid ejecting head and a liquid ejecting apparatus which is useful when applied to those employing a circulation type in which a liquid is circulated via each of pressure generation chambers between a first and second manifolds which are liquid storage sections arranged in both sides across a plurality of pressure generation chambers having nozzle openings and communicating with each of the pressure generation chambers.

2. Related Art

As a liquid ejecting apparatus, for example, there is provided an ink jet type recording apparatus including an ink jet type recording head (hereinafter, simply referred to as a recording head) which has a plurality of pressure generation chambers which generates a pressure with a pressure generation unit configured of a piezoelectric element to eject ink droplets, an ink supply path which supplies the ink individually from a common manifold to each of the pressure generation chambers and a nozzle opening which is formed in each of the pressure generation chambers and ejects ink droplets (see, for example, JP-A-2002-355961 and Japanese Patent No. 3097718).

In the ink jet type recording apparatus described above, the ink droplets are ejected from the nozzle opening to the outside and are landed on a predetermined position of a medium such as a paper by applying an ejection energy to the ink inside the pressure generation chamber, communicating with the nozzle opening corresponding to a printing signal.

Accordingly, in the recording head of the ink jet type recording apparatus of this type, the nozzle opening is exposed to the atmosphere. Thus, the ink is thickened by evaporation of moisture through the nozzle opening and it may cause adverse effect to ejection characteristics of the ink droplets. In other words, when even a portion of the ink is thickened, an ejection amount and an ejection speed of the ink droplets via the nozzle opening are changed, and a defect, in which variation of the landing occurs, is generated.

In order to avoid the defect described above, there has been studies such that the ink does not stay in the vicinity of the nozzle opening by circulating the ink in the pressure generation chamber communicating with the nozzle opening. In other words, the recording head of the circulation type described above is configured such that the liquid is circulated via each of the pressure generation chambers between the first and second manifolds which are the liquid storage sections disposed in both sides across a plurality of pressure generation chambers having nozzle openings and communicating with each of the pressure generation chambers.

However, in the recording head applying the circulation type described above, when the circulation amount of the ink is large, the flow of the ink inside the pressure generation chamber is fast and the ink is hardly ejected from the nozzle opening. As a result, there is a problem that stable ejection is disturbed. In addition, when the circulation amount is small, in particular, the number of the ejection nozzles is increased and when required ejection amount is increased, there is a problem that shortage of the ejection amount of the ink occurs. Thus, a study is required in order to simultaneously satisfy the two conflicting requirements.

In addition, such a problem exists similarly in the liquid ejecting head ejecting other liquids as well as the ink jet type recording head ejecting the ink.

SUMMARY

An advantage of some aspects of the invention is to provide a liquid ejecting head and a liquid ejecting apparatus in which it is possible to sufficiently slow down the speed of the liquid flowing inside a pressure generation chamber due to circulation and, at the same time, it is possible to secure sufficient amount of the liquid for ejection inside the pressure generation chamber.

According to an aspect of the invention, there is provided a liquid ejecting head including: a flow path member having a pressure generation chamber which communicates with a plurality of nozzle openings, respectively; a first liquid storage section which communicates with each of the pressure generation chambers; and a second liquid storage section which communicates with the pressure generation chamber on the opposite side of the first liquid storage section, wherein a liquid is ejected via the nozzle openings by applying a pressure to the liquid filled in the pressure generation chamber by a pressure generation unit, wherein the liquid is circulated between the first liquid storage section and the second liquid storage section via the pressure generation chamber, wherein the flow path member has a first and second bypass flow paths which connect the first and second liquid storage sections, respectively in two locations of one end side and the other end side of a nozzle row on the outside of the nozzle row in which the nozzle openings are formed, and wherein a relationship between a flow path resistance R of the first and second bypass flow paths, and a flow path resistance r of a flow path portion including each of the pressure generation chambers which connect the first and second liquid storage sections is $R<r/N$ (wherein, N is the number of all nozzle openings).

In the aspect, since the relationship between the flow path resistance R of the first and second bypass flow paths, and the flow path resistance r of a flow path portion including each of the pressure generation chambers which connect the first and second liquid storage sections is $R<r/N$, most of the liquid which is circulated flows via the first and second bypass flow paths. As a result, a flow amount of the circulation stream which flows via each of the pressure generation chambers is suppressed. As a result, when the pressure generation unit is driven, the generated pressure is favorably transmitted to the liquid inside the pressure generation chamber and a predetermined amount of liquid droplets is ejected from the nozzle opening. In other words, influence of the circulation stream to the ejection characteristics can be suppressed as much as possible.

Here, the circulation stream, even a small amount, in the pressure generation chamber, does not interfere with the effect on thickening of the liquid. This is because the thickening of the liquid can be prevented if the liquid does not stop and even a small amount is moved.

In addition, since a sufficient amount required for the ejection of the liquid droplets is circulated via the nozzle opening including the first and second flow paths, also in this regard, it does not cause adverse effect to the ejection characteristics.

Here, in the configuration described above, two pressure generation chambers may face each other in a direction orthogonal to the nozzle row, front end portions thereof may communicate with each other via a communication path and the nozzle openings adjacent in the nozzle row direction may be arranged in a zigzag shape in one side of the nozzle row and the other side of the nozzle row. In this case, when high-densification is planned by the arrangement of the nozzle openings in the zigzag shape, reduction of the size of the head can be obtained. In addition, the portion corresponding to the second liquid storage section in the first embodiment is removed and the front end portions of two pressure generation chambers facing each other communicate with each other via the circulation communication path.

According to another aspect of the invention, there is provided a liquid ejecting apparatus including the liquid ejecting head described above.

In the aspect, even if the recording head employing a circulation type is mounted, favorable ejection characteristics can be obtained. As a result, deterioration of the ejection characteristics due to the thickening of the liquid and deterioration of the ejection characteristics due to the circulation stream in the circulation system are suppressed, at the same time, and then it can contribute to the creation of high-quality printed matter, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described, based on the drawings.

First Embodiment

Figure 1:
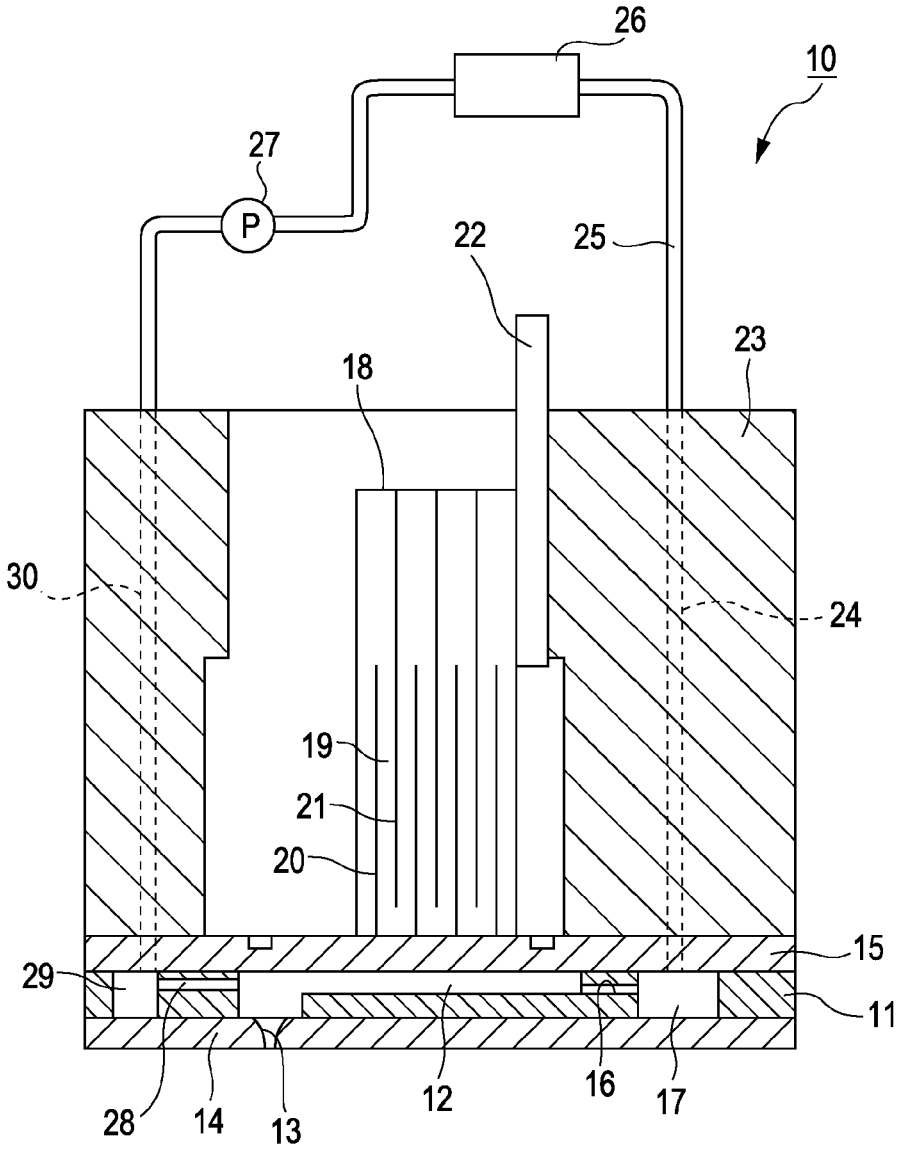
FIG. 1 is a cross-sectional view which is taken along a line I-I of a recording head in FIG. 2 according to a first embodiment of the invention.

FIG. 1 is a cross-sectional view illustrating a recording head of the first embodiment of the invention. As illustrated in the same view, an ink jet type recording head 10 according to the embodiment is a type having a vertical vibration type piezoelectric element and is configuration such that a plurality of pressure generation chambers 12 are arranged parallel to each other in a flow path substrate 11 and both sides of the flow path substrate 11 in the thickness direction (in the vertical direction in the drawing) are sealed by a nozzle plate 14 having a nozzle opening 13 with respect to each of pressure generation chambers 12 and a vibration plate 15. Here, the nozzle opening 13 is formed in a taper shape of which the diameter is gradually reduced toward the opening.

In addition, the flow path substrate 11 has a first manifold 17 which is a first liquid storage section that is a common ink chamber of the plurality of pressure generation chambers 12 by communicating with each of the pressure generation chambers 12 via each of the ink supply ports 16. The first manifold 17 faces an opening portion of one side (the lower end side in the drawing) of an ink supply path 24 which introduces the ink by passing through a case head 23 and a vibration plate 15.

A front end of the piezoelectric element 18 abuts a region corresponding to each of the pressure generation chambers 12 on the opposite side of the pressure generation chamber 12 in the vibration plate 15. In the piezoelectric element 18, a piezoelectric material 19 and electrode forming materials 20 and 21 are laminated alternately and vertically in a sandwiched shape, and an inactive region which does not contribute to the vibration is fixed to the case head 23 via the fixed substrate 22. The fixed substrate 22, the vibration plate 15, the flow path substrate 11 and the nozzle plate 14 are integrally fixed to each other via the case head 23.

A second manifold 29 that is a second liquid storage section is formed in parallel with the first manifold 17 on the opposite side of the first manifold 17 across the pressure generation chamber 12 in the flow path substrate 11 and communicates with the pressure generation chamber 12 via a circulation communication path 28. Thus, the circulation communication path 28 communicates with the pressure generation chamber 12 on the same side with the nozzle opening 13 in the pressure generation chamber 12. The second manifold 29 faces an opening portion of one side (the lower end side in the drawing) of an ink discharging path 30 which discharges the ink by passing through the vibration plate 15 and the case head 23.

The ink supply path 24 and the opening portion of the other side (the upper end side in the drawing) of the ink discharging path 30 communicate with the flow path 25, and an ink cartridge 26 that is an ink storage section and a pump 27 are disposed in the middle of the flow path 25.

Thus, ink circulation in the embodiment is forcedly performed using a driving force of the pump 27. In other words, the ink is circulated in a path in which the ink leads to inside the first manifold 17 via the flow path 25 and the ink supply path 24 from the ink cartridge 26 in which the ink is stored, and returns to the ink cartridge 26 via the ink supply port 16, the pressure generation chamber 12, the circulation communication path 28, the second manifold 29, the ink discharging path 30, the flow path 25 and the pump 27.

Figure 2:
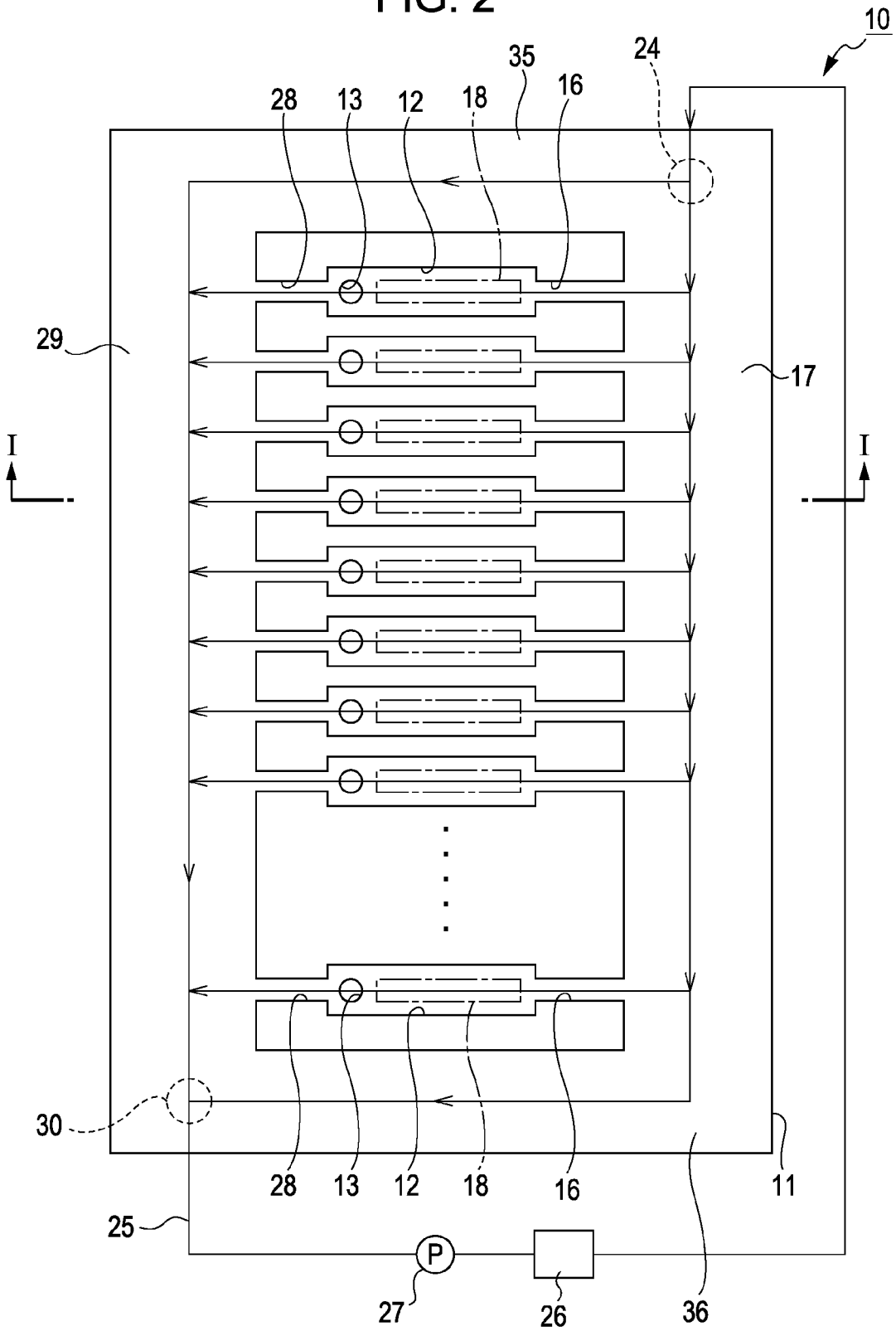
FIG. 2 is a schematic plan view illustrating planarly a flow path substrate in FIG. 1.

FIG. 2 is a schematic plan view illustrating planarly a flow path substrate in FIG. 1. In the drawing, the same reference numeral will be denoted to the same configuration in FIG. 1 and repeated description thereof will be omitted. As illustrated in FIG. 2, the flow path substrate 11 has a first and second bypass flow paths 35 and 36 which connect the first and the second manifolds 17 and 29, respectively, in two locations of one end side (the upper end side in the drawing) and the other end side (the lower end side in the drawing) of the nozzle row on the outside of the nozzle row (the row in the vertical direction in FIG. 2) which is formed by the nozzle openings 13.

Here, the embodiment is configured such that a relationship between a flow path resistance R of the first and second bypass flow paths 35 and 36 and a flow path resistance r of a flow path portion (the ink supply port 16+the pressure generation chamber 12+the circulation communication path 28) including each of the pressure generation chambers 12 which connects the first and second manifolds 17 and 29 is $R<r/N$ (wherein, N is the number of all nozzle openings).

As a result, the ink supplied inside the first manifold 17 via the ink supply path 24 is introduced in the second manifold 29 via each of the ink supply ports 16, the pressure generation chamber 12 and the circulation communication path 28, and is introduced in the second manifold 29 via the first and second bypass flow paths 35 and 36, at the same time. Here, since the relationship between the flow path resistance R of the first and second bypass flow paths 35 and 36, and the flow path resistance r of the flow path portion including each of the pressure generation chambers 12 which connect the first and second manifolds 17 and 29 is R<r/N, most of the ink which is circulated flows via the first and second bypass flow paths 35 and 36. As a result, a flow amount of the circulation stream which flows via each of the pressure generation chambers 12 is suppressed.

In the ink jet type recording head 10 configured as described above, the ink is supplied to the first manifold 17 via the flow path 25 and the ink supply path 24 communicating with the ink cartridge 26, and is distributed to each of the pressure generation chambers 12 via the ink supply port 16. In this state, the piezoelectric element 18 is contracted by applying the voltage to the piezoelectric element 18. Accordingly, the vibration plate 15 is deformed (pulled upwards in the drawing) with the piezoelectric element 18 so that the volume of the pressure generation chamber 12 expanded and the ink is drawn into the pressure generation chamber 12. Then, when the voltage applied to the electrode forming materials 20 and 21 of the piezoelectric element 18, based on the driving signal for ejecting, is released after the ink is filled up to the nozzle opening 13, the piezoelectric element 18 is extended and then returns to the original state. Accordingly, since the vibration plate 15 is also displaced and then returns to the original state, the pressure generation chamber 12 is contracted and an internal pressure thereof is increased and then the ink droplet is ejected from the nozzle opening 13.

Here, in the embodiment described above, the ink is circulated using the pump 27 that is an external driving source, however, since most of the ink introduced into the first manifold 17 is introduced into the second manifold 29 via the first and second bypass flow paths 35 and 36, and the flow speed of the circulation stream inside each of the pressure generation chambers 12 is suppressed, if the piezoelectric element 18 is driven, the generated pressure is transmitted favorably to the ink inside the pressure generation chamber 12 and a predetermined amount of ink droplets are ejected from the nozzle opening 13. In other words, good ejection characteristics can be obtained.

Meanwhile, since the circulation stream is generated in the pressure generation chamber 12 even though the amount thereof is small, effect of preventing thickening of the ink can be obtained. When the ink does not stop in the vicinity of the nozzle opening 13 and moves even a little, the thickening is prevented. At the same time, since the circulation path also includes first and second bypass flow paths 35 and 36, sufficient circulation amount of the ink is secured and the ejection of the ink droplets via the nozzle opening 13 is not interfered.

Second Embodiment

Figure 3:
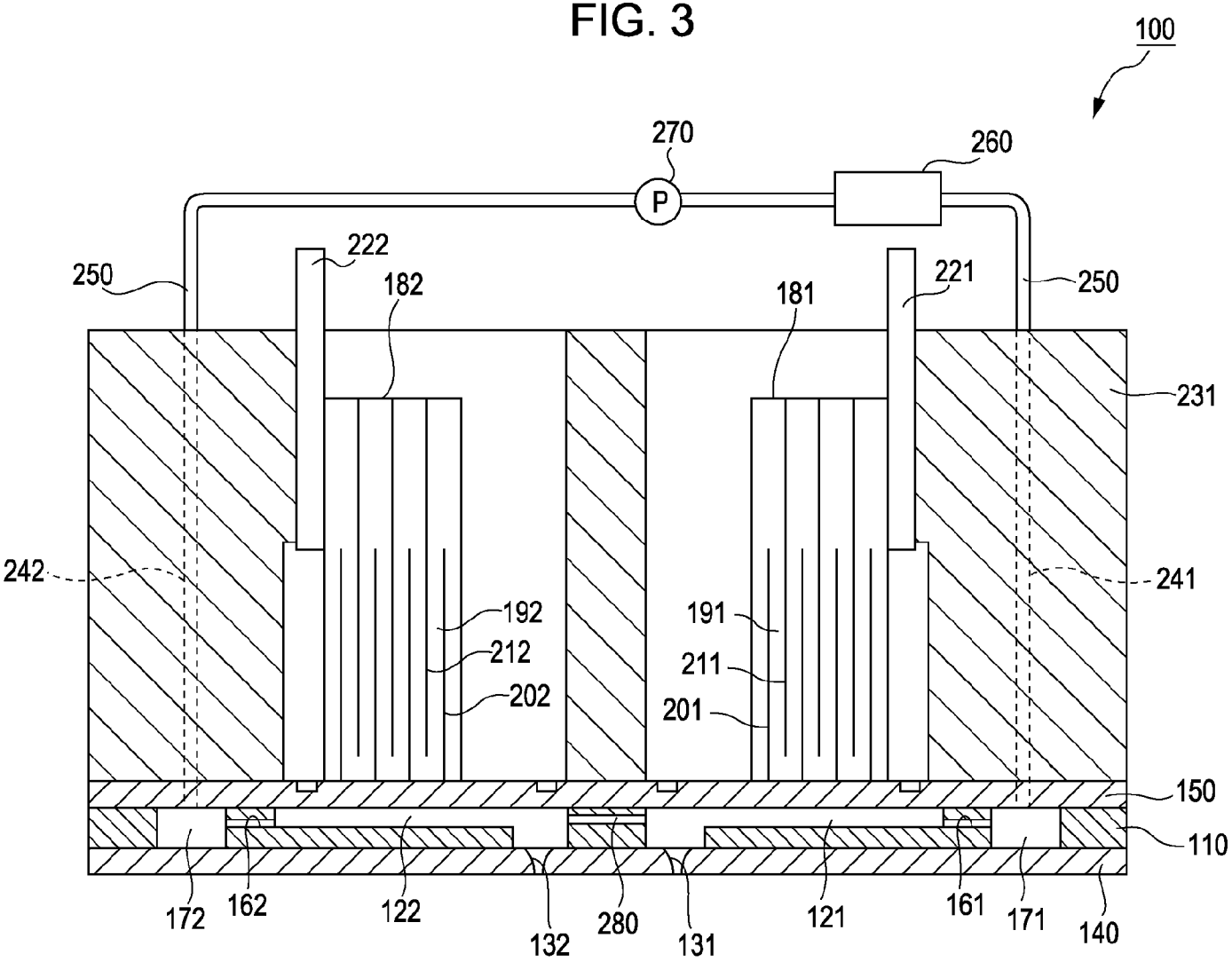
FIG. 3 is a cross-sectional view which is taken along a line III-III of a recording head in FIG. 4 according to a second embodiment of the invention.
Figure 4:
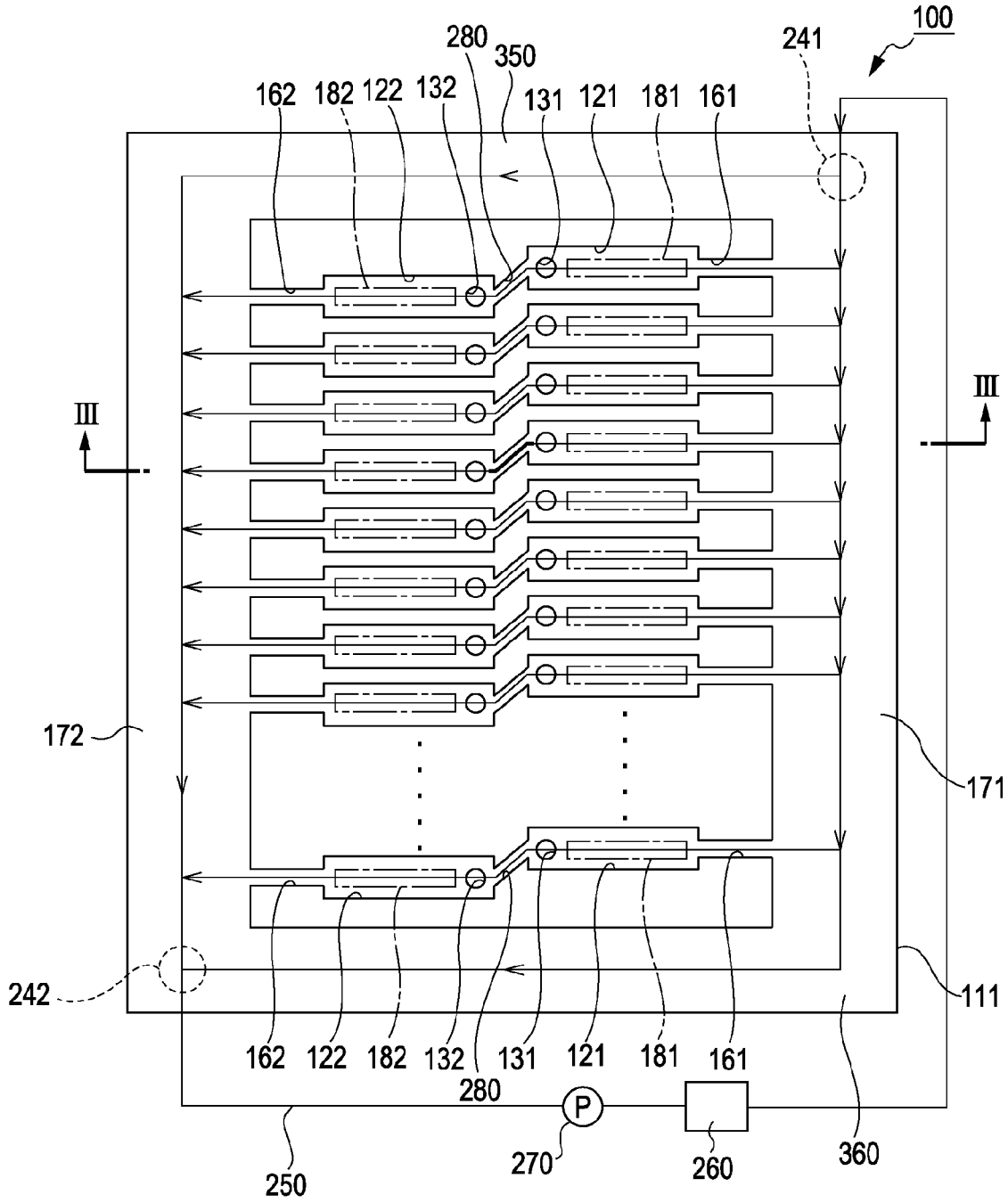
FIG. 4 is a schematic plan view illustrating planarly a flow path substrate in FIG. 3.

FIG. 3 is a cross-sectional view which is taken along a line III-III of the recording head in FIG. 4 according to the second embodiment of the invention. FIG. 4 is a schematic plan view illustrating planarly the flow path substrate in FIG. 3.

As illustrated in FIGS. 3 and 4, a recording head 100 according to the embodiment is configured by joining two recording heads 10, as illustrated in FIGS. 1 and 2, to face each other. At this time, the nozzle row, in which one side and the other side nozzle openings 131 and 132, arranged in a nozzle plate 140, is configured such that the nozzle openings 131 and 132 adjacent to each other in the nozzle row direction are arranged in a zigzag shape. In addition, the front portions of pressure generation chambers 121 and 122 facing each other in a flow path substrate 110 communicate with each other through a circulation communication path 280. Here, since the nozzle openings 131 and 132 are arranged in the zigzag shape, the circulation communication path 280 is inclined about the center lines of the pressure generation chambers 121 and 122 in the longitudinal direction thereof.

A first and second manifolds 171 and 172 are formed on both end portions of the flow path substrate 110 across the pressure generation chambers 121 and 122 communicating with each other via the circulation communication path 280. The first and second manifolds 171 and 172 communicate with each other via an ink supply port 161, the pressure generation chamber 121, the circulation communication path 280, the pressure generation chamber 122 and an ink discharging path 162.

Furthermore, the flow path substrate 110 has a first and second bypass flow paths 350 and 360 which connect the first and second manifolds 171 and 172 to two locations of one end side (the upper end side in the drawing) and the other end side (the lower end side in the drawing) of the nozzle row on the outside of the nozzle row (the row in the vertical direction in FIG. 4) which is formed by the nozzle openings 131 and 132. Here, the embodiment is configured such that a relationship between a flow path resistance R of the first and second bypass flow paths 350 and 360, and a flow path resistance r of a flow path portion (the ink supply port 161+the pressure generation chamber 121+the circulation communication path 280+the pressure generation chamber 122+the ink discharging path 162) including each of the pressure generation chambers 121 and 122 which connect the first and second manifolds 171 and 172 is R<r/N (wherein, N is the number of all nozzle openings).

Thus, the ink is circulated in a path in which the ink leads to inside the first manifold 171 via the flow path 250 and the ink supply path 241 from the ink cartridge 260, and returns to the ink cartridge 260 via the ink supply port 161, the pressure generation chamber 121, the circulation communication path 280, the pressure generation chamber 122, the ink discharging path 162, the second manifold 172, an ink discharge path 242, the flow path 250 and the pump 270. At the same time the circulation path is also formed via the first and second bypass flow paths 350 and 360.

Meanwhile, front ends of the piezoelectric elements 181 and 182 abut regions corresponding to each of the pressure generation chambers 121 and 122 on the opposite side of the pressure generation chambers 121 and 122 in the vibration plate 150. In the piezoelectric elements 181 and 182, piezoelectric materials 191 and 192 and electrode forming materials 201 and 202 are laminated alternately and vertically in a sandwiched shape, and inactive regions which do not contribute to the vibration are fixed to a case head 231 via fixed substrates 221 and 222. In addition, the fixed substrate 221, the vibration plate 150, the flow path substrate 110 and the nozzle plate 140 are integrally fixed to each other via the case head 231.

In the embodiment, similar to the first embodiment, most of the ink which is circulated is flowed via the first and second bypass flow paths 350 and 360. As a result, a flow amount of the circulation stream which flows via each of the pressure generation chambers 121 and 122 is suppressed. In addition, if the piezoelectric elements 181 and 182 are driven, the generated pressure is transmitted favorably to the ink inside the pressure generation chambers 121 and 122, and a predetermined amount of ink droplets are favorably ejected from the nozzle openings 131 and 132. The embodiment is also configured, such that the relationship between the flow path resistance R of the first and second bypass flow paths 350 and 360 and the flow path resistance r of flow path portion including each of the pressure generation chambers 121 and 122 which connect the first and second manifolds 171 and 172 is R<r/N.

Furthermore, in the embodiment, when the ink does not stop in the vicinity of the nozzle openings 131 and 132 and moves even a little, the thickening of the ink is effectively prevented.

In addition, according to the embodiment, when high-densification is planned by the arrangement of the nozzle openings 131 and 132 in the zigzag shape, reduction of the size of the head can be obtained. In addition, the portion corresponding to the second manifold 29 in the first embodiment is removed and the front ends of two pressure generation chambers 121 and 122 facing each other communicate with each other via the circulation communication path 280 so that the reduction of the size of the recording head 100 can be also realized.

In the above description, the embodiments of the invention is described, however, the invention is of course not limited to the embodiments. For example, the ink jet type recording head according to the embodiments described above is the head having the vertical vibration type actuator in which the piezoelectric material and the electrode forming material are alternately laminated and are contracted and expanded in the axial direction, however, the invention may be applied similarly to a head having a piezoelectric element that is a thin-film type actuator as a pressure generation unit which generates pressure change in the pressure generation chamber, a head having a piezoelectric element that is a thick-film type actuator that is formed by attaching a green sheet or the like. Furthermore, the invention may be applied to a so-called bubble type actuator in which a heating element is arranged inside the pressure generation chamber as the pressure generation unit and liquid droplets are ejected from a nozzle opening by bubbles generated using the heat of the heating element, or a so-called electrostatic actuator in which static electricity is generated between a vibration plate and an electrode, the vibration plate is deformed by a force of the static electricity, and then the liquid droplets are ejected from the nozzle opening.

Furthermore, the invention is widely intended for general liquid ejecting heads and, naturally, can be applied to a liquid ejecting head ejecting a liquid other than ink. The liquid ejecting head in addition thereto, for example, includes various recording heads used for an image recording apparatus such as a printer, a color material ejecting head used for producing a color filter of a liquid crystal display or the like, an electrode material ejecting head used for forming the electrode of an organic EL display, Field Emission Display (FED) or the like, a bioorganic matter ejecting head used for producing a bio chip, or the like.

Figure 5:
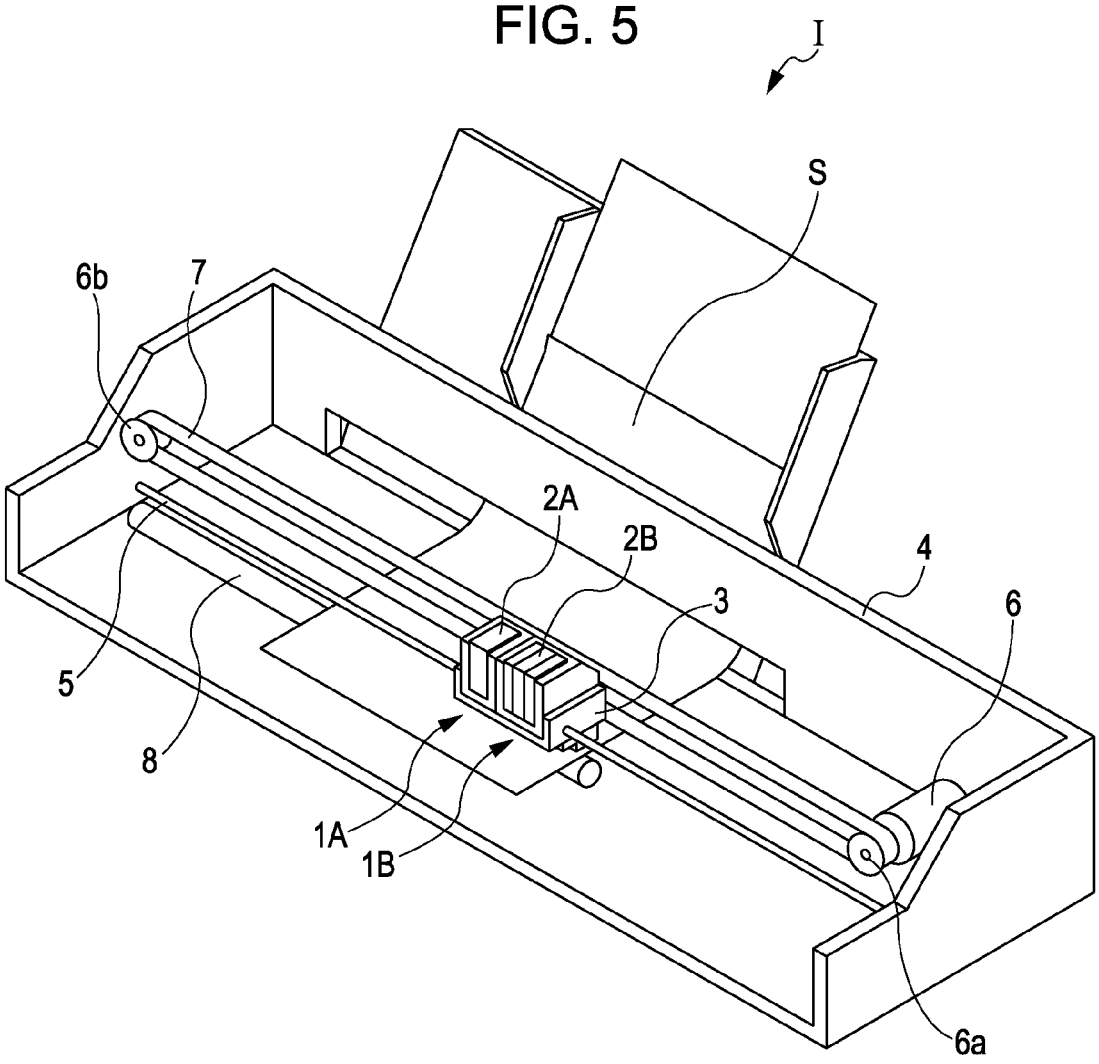
FIG. 5 is a schematic perspective view of an ink jet type recording apparatus according to an embodiment of the invention.

The ink jet type recording head according to the embodiments described above is equipped in the ink jet type recording apparatus. FIG. 5 is a schematic view illustrating an example of the ink jet type recording apparatus. As illustrated in the drawing, the ink jet type recording apparatus I according to the embodiment has ink jet type recording heads 1A and 1B according to the embodiment described above, and ink cartridges 2A and 2B configuring a supply unit which supplies the ink to the recording heads 1A and 1B are detachably provided in the ink jet type recording apparatus I. The carriage 3 having the recording heads 1A and 1B is provided in a carriage shaft 5 mounted on an apparatus body 4 so as to be movable in the axial direction. The recording heads 1A and 1B eject a black ink composition and a color ink composition respectively.

In addition, in the vicinity of one end portion of the carriage shaft 5, a driving motor 6 is provided. In the front end portion of a shaft of the driving motor 6, a first pulley 6*a* having a groove at the outer periphery thereof is provided. Furthermore, in the vicinity of the other end portion of the carriage shaft 5, a second pulley 6*b* corresponding to the first pulley 6*a* of the driving motor 6 is rotatably provided. A timing belt 7 formed of an elastic member such as a rubber in a circular shape is applied between the first pulley 6*a* and the second pulley 6*b*.

Then, the driving force of the driving motor 6 is transmitted to the carriage 3 via the timing belt 7 so that the recording heads 1A and 1B mounted on the carriage 3 is moved along the carriage shaft 5. Meanwhile, a platen 8 is provided along the carriage 3 in the apparatus body 4. The platen 8 can be rotated by the driving force of a paper feeding motor (not illustrated) and a recording sheet S that is a recording medium such as a paper fed by a paper feeding roller or the like is wound around the platen 8 so as to be transported.

The entire disclosure of Japanese Patent Application No. 2012-051039, filed Mar. 7, 2012, is incorporated by reference herein.

What is claimed is:

1. A liquid ejecting head comprising:

a flow path member having a pressure generation chamber which communicates with a plurality of nozzle openings, respectively; a first liquid storage section which communicates with each of the pressure generation chambers; and a second liquid storage section which communicates with the pressure generation chamber on the opposite side of the first liquid storage section, wherein a liquid droplet is ejected via the plurality of nozzle openings by applying a pressure to the liquid filled in the pressure generation chamber by a pressure generation unit, wherein the liquid is circulated between the first liquid storage section and the second liquid storage section via the pressure generation chamber, wherein the flow path member has a first and second bypass flow paths which connect the first and second liquid storage sections, respectively in two locations of one end side and the other end side of a nozzle row on the outside of the nozzle row in which the nozzle openings are formed, and wherein a relationship between a flow path resistance R of the first and second bypass flow paths, and a flow path resistance r of a flow path portion including each of the pressure generation chambers which connect the first and second liquid storage sections is $R<r/N$ (wherein, N is the number of all nozzle openings).

2. The liquid ejecting head according to claim 1, wherein two pressure generation chambers face each other in a direction orthogonal to the nozzle row, front end portions thereof communicate with each other via a communication path and the nozzle openings adjacent in the nozzle row direction are arranged in a zigzag shape in one side of the nozzle row and the other side of the nozzle row.

3. A liquid ejecting apparatus including the liquid ejecting head according to claim 1.

4. A liquid ejecting apparatus including the liquid ejecting head according to claim 2.

* * * * *